United States Patent [19]

Stehning

[11] Patent Number: 4,584,147

[45] Date of Patent: Apr. 22, 1986

[54] SWIRL NOZZLES, ESPECIALLY FOR SCRUBBING TOWERS FOR FLUE GASES

[75] Inventor: Werner Stehning, Dorsten, Fed. Rep. of Germany

[73] Assignee: Gottfried Bischoff Bau kompl. Gasreinigungs- und Wasserrückkühlanlagen GmbH & Co. Kommanditgesellschaft, Essen, Fed. Rep. of Germany

[21] Appl. No.: 707,430

[22] Filed: Mar. 1, 1985

[30] Foreign Application Priority Data

Mar. 2, 1984 [DE] Fed. Rep. of Germany ..... 3407706

[51] Int. Cl.[4] ..... B01F 3/04

[52] U.S. Cl. ..... 261/115; 55/220; 239/469; 239/DIG. 19; 261/DIG. 9

[58] Field of Search ..... 261/115–118, 261/110, 111, DIG. 9, DIG. 11; 239/469, DIG. 19; 422/168, 240, 241; 423/242 R; 55/228, 223, 220

[56] References Cited

U.S. PATENT DOCUMENTS

| | | | |
|---|---|---|---|
| 1,517,598 | 12/1924 | Stevenson | 239/469 X |
| 3,326,473 | 6/1967 | Wahlin | 239/469 X |
| 3,726,065 | 4/1973 | Hausberg et al. | 261/115 X |
| 3,880,597 | 4/1975 | Goldschmidt et al. | 55/220 X |
| 4,261,511 | 4/1981 | Erb et al. | 261/118 X |
| 4,426,041 | 1/1984 | Nieuwkamp et al. | 239/469 X |
| 4,494,698 | 1/1985 | Brown et al. | 239/DIG. 19 |
| 4,515,754 | 5/1985 | Stehning | 422/168 |
| 4,526,764 | 7/1985 | Stehning | 423/242 |
| 4,533,522 | 8/1985 | Leimkuhler | 423/242 X |
| 4,539,024 | 9/1985 | Stehning et al. | 55/223 |

FOREIGN PATENT DOCUMENTS

| | | | |
|---|---|---|---|
| 31289 | 3/1978 | Japan | 239/DIG. 19 |
| 143161 | 8/1983 | Japan | 239/DIG. 19 |

*Primary Examiner*—Richard L. Chiesa
*Attorney, Agent, or Firm*—Karl F. Ross; Herbert Dubno

[57] ABSTRACT

Swirl nozzles, especially for plants with flue gas scrubbers for the physical and/or chemical purification of flue gases emanating from power plant boiler installations. The nozzles include a substantially cylindrical nozzle chamber, at least one tangential scrubber fluid inlet into the nozzle chamber, and at least one nozzle bore arranged in a nozzle chamber bottom and extending coaxially with its axis with respect to the nozzle chamber. A conduit for feeding scrubber fluid can be secured at the tangential scrubber fluid inlet, and this conduit carries the swirl nozzle apparatus. The nozzle chamber and the inlet are provided in a body made of ceramic wear material, with the respective ends of the chamber also made of ceramic wear material and connected to the body. At least one chamber bottom includes the nozzle bore. The body and the nozzle chamber bottoms are arranged between steel stress plates. At least the body can be held under pretension condition between these stress plates. One of the stress plates includes an aperture at which can follow the scrubber fluid inlet, and it is also equipped with a short connecting pipe for the conduit for feeding a scrubber fluid.

17 Claims, 5 Drawing Figures

SWIRL NOZZLES, ESPECIALLY FOR SCRUBBING TOWERS FOR FLUE GASES

FIELD OF THE INVENTION

My present invention relates to swirl nozzle devices, especially for plants with flue gas scrubber towers for physical and/or chemical cleaning of flue gases, for example emanating from boiler installations of electricity-generating power plants and the like.

BACKGROUND OF THE INVENTION

Swirl nozzles can include a vessel or body with a substantially cylindrical nozzle chamber, at least one tangential scrubber fluid inlet into the nozzle chamber, and at least one nozzle bore arranged in a nozzle chamber bottom and extending coaxially with its respective axis with respect to the nozzle chamber. A conduit for feeding the scrubber, or scrubbing or wash fluid, can be secured at the tangential scrubber fluid inlet, and this conduit carries, supports or secures the position of the swirl nozzle.

Conventional swirl nozzles of this type in practical use are made of a steel inclusive of the scrubbing fluid inlet fitting. The nozzle chamber is provided in a cylindrical vessel or pot-like structure. The scrubbing or scrubber fluid inlet is provided then by a short pipe or nipple which is welded to the vessel.

The demands made of such a swirl nozzle are considerable. This applies particularly when the scrubber or scrubbing fluid also contains solid particles, for example in the form of finely divided or finely ground limestone, or contains acidic components or acids. Accordingly, the cylindrical nozzle chamber has to withstand wear, erosion and corrosion.

When the scrubbing fluid exits from the nozzle bore or bores, the entire system or structure is additionally subject to vibration. These vibrations must be absorbed in the known devices by the nipple or short pipe end which forms the scrubber fluid inlet. Thus the assembly is generally fully supported by the feed conduit for the introduction of the scrubbing fluid or liquid. This requires mounting of the feed conduit so as to withstand such vibrations.

All these factors are considered in the prior art in such a way that with respect to mechanical aspects and with respect to vibration no problems arise, i.e. the usual precautions suffice. The fatigue resistance meets all requirements. With respect to wear and corrosion resistance, however, the known devices leave much to be desired.

Recently ceramic wear materials have become known in other technological areas. For example, ceramic wear material is used in cutter plates for shaping metallic parts with machine tools, i.e. cutting techniques leaving shavings, chips, turnings and similar remains. The wear materials have also been used as wear cladding for structural components and machine parts which are particularly prone to wear and which have been made of steel in the past.

The ceramic wear materials are then secured as plates or the like at the machine parts or elements which are subjected to wear. One might think, correspondingly, that the aforedescribed swirl nozzles could be clad in their wear-prone regions, for example in the nozzle chamber, with a ceramic wear material, armoring the region as it were. However, such a solution is difficult to implement and, accordingly, cumbersome. On the other hand, such ceramic wear materials can withstand compressive-load applications or requirements, but they can only be subjected to minor tensile loads, and only to low bending stress.

Accordingly, the known swirl nozzles as a whole can not readily be made of ceramic wear materials. Particularly the ability to withstand vibration is not sufficient and early break-down or failure is experienced.

The term "ceramic wear material" is used here to refer to a ceramic which has an excellent resistance to abrasive wear.

OBJECTS OF THE INVENTION

It is therefore the principal object of this invention to provide a swirl nozzle which has improved wear resistance when compared with hitherto known swirl nozzles.

It is also an object of the invention to provide a swirl nozzle with reduced wear and without the expected tendency to premature breakdown.

It is furthermore an object of the invention to provide swirl nozzles which are easily installed at appropriate locations.

SUMMARY OF THE INVENTION

These objects are attained in accordance with the invention in that the nozzle chamber as well as the scrubber fluid inlet is formed in a block or body made of ceramic wear material. On each of the two sides or ends of the body is connected a nozzle chamber bottom, preferably also made of ceramic wear material. At least one nozzle chamber bottom includes the respective nozzle bore. It is also contemplated that the body as well as the nozzle chamber bottoms is arranged between stress plates made of steel. Also, at least the body is held with the aid of tensioning screws between these stress plates and under prestress in the compression sense.

Furthermore, one of the stress plates includes an aperture to which is connected the scrubber fluid inlet. This inlet can be a short connecting conduit or nipple which serves to connect the conduit for feeding scrubber fluid to the system.

A preferred wear material is silicon carbide or nitrided silicon carbide or silicon nitride.

A block or body as described of such ceramic wear material can be prestressed in compression between stress plates, and in such a way that the ceramic block is not subjected to detrimental or disruptive tensile loads, bending or vibration stress or conditions, because it is maintained under pressure prestress.

At the same time, one of the stress plates absorbs the loads or stresses arising due to aspects of assembly or installation, because the feed conduit for the scrubber fluid carries or supports the swirl nozzle as a whole.

Thus bending stresses and also vibrational stresses as they arise, can be absorbed by metallic components which are used and which are designed to have the required fatigue strength or life.

Specific embodiments within the invention are deserving of special consideration:

A preferred embodiment has the body divided in or at a central plane, which plane extends orthogonally or perpendicularly to the axis of the cylindrical nozzle chamber.

In another embodiment the body is unitary and it includes at each end or side an integral or unitary respective nozzle chamber bottom. Alternatively the bottoms can be formed by plates attached to the ceramic body to close the cylindrical chamber.

It is also preferred that the short connecting conduit or nipple be secured by welding in and at the associated stress plate.

BRIEF DESCRIPTION OF THE DRAWINGS

The above and other objects, features and advantages will become more readily apparent from the following description, reference being made to the accompanying drawing, in which.

SPECIFIC DESCRIPTION

Figure 1:
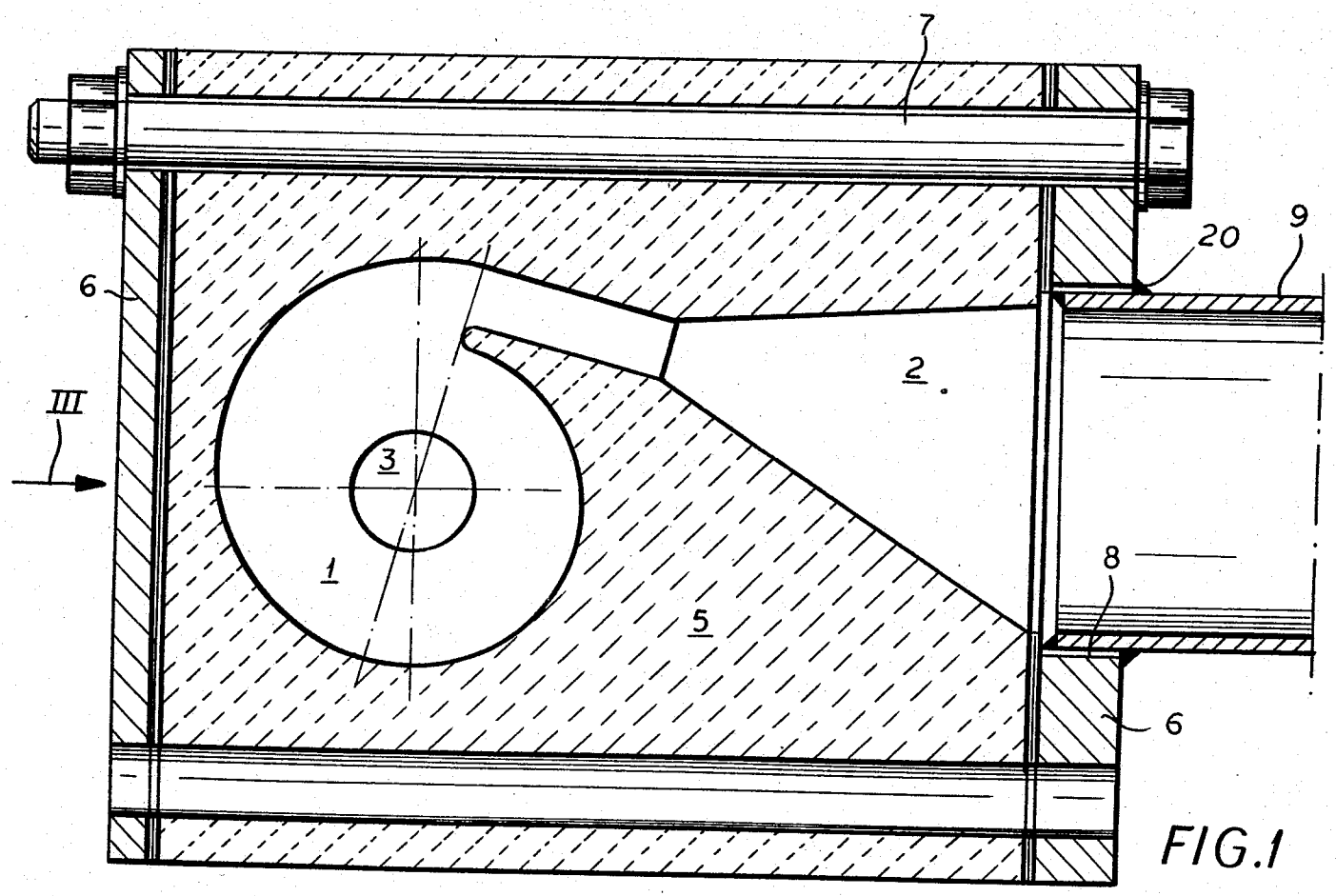
FIG. 1 is a cross section of a swirl nozzle in accordance with one embodiment of the invention orthogonally with respect to the axis of the nozzle chamber.

The swirl nozzle or scrubber device shown in the drawing is especially intended for use in scrubber towers for treating flue gas, for example of installations for physical and/or chemical cleaning of flue gases downstream of a boiler installation for a power plant.

Figure 2:
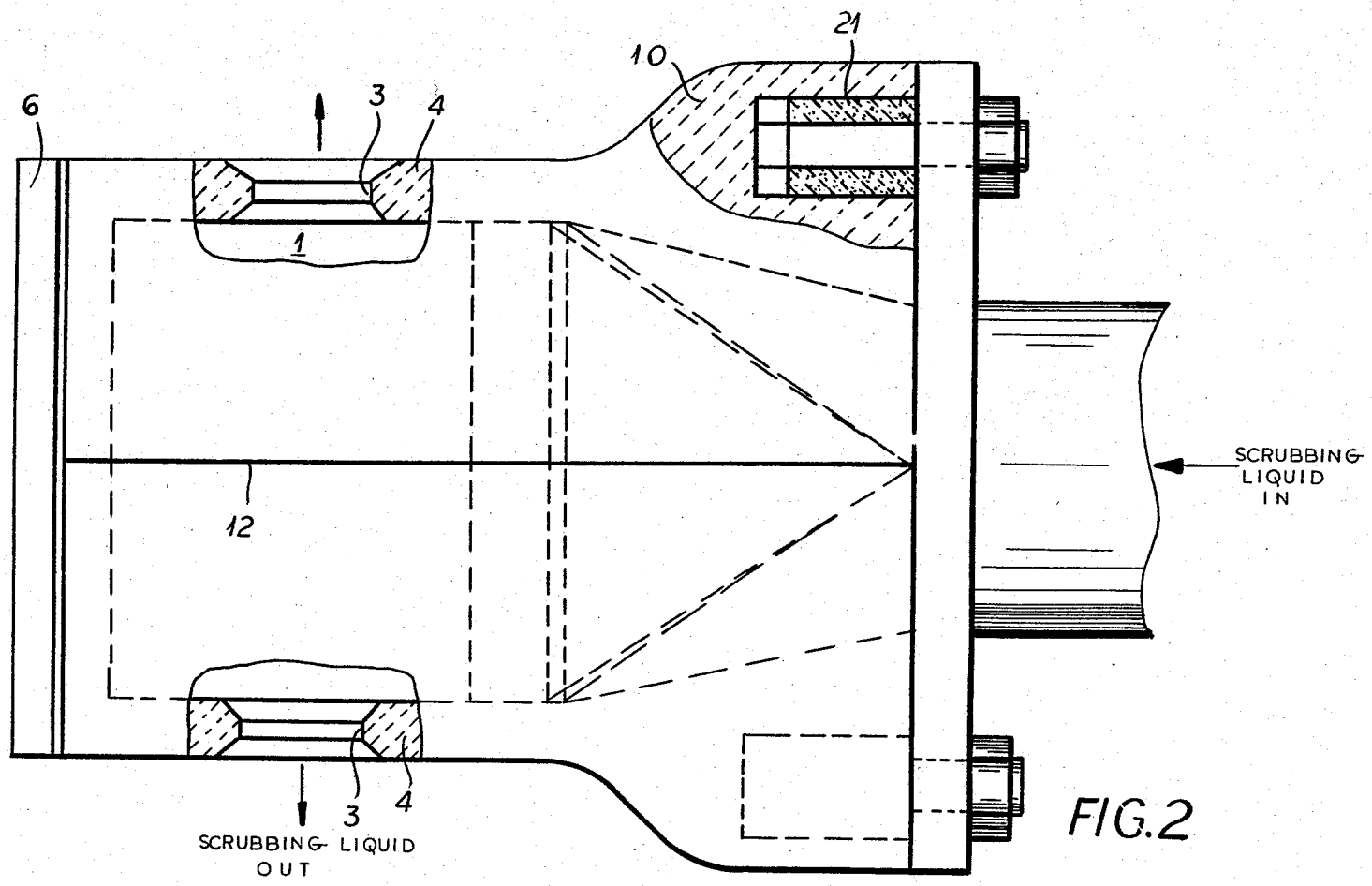
FIG. 2 is a side elevation of the embodiment of FIG. 1 partly broken away.

The device basically includes a substantially cylindrical nozzle chamber 1, a tangential scrubber or scrubbing fluid inlet 2 opening into the nozzle chamber 1, and two nozzle bores 3 arranged in the two nozzle chamber bottoms 4. Two nozzle bores 3 extend coaxially with respect to the nozzle chamber 1, i.e. the respective central axis of the nozzle bores 3 are coaxially aligned (see FIG. 2).

A feed conduit 9 for introducing or supplying the scrubber or scrubbing fluid can be connected at the tangential scrubber fluid inlet 2. This conduit 9 carries the swirl nozzle or device.

The nozzle chamber 1 and the scrubber fluid inlet 2 is formed directly in a block or body 5 which is shaped by machining, for example. The body 5 is made of ceramic wear material, for example silicon carbide or nitrided silicon carbide or silicon nitride.

A respective nozzle chamber bottom 4 is formed initially at each side or end of body 5 (FIGS. 1-3) or can be attached as plates by ceramic slip bonding or the like (FIG. 4), the bottoms being likewise made of the ceramic wear material. As mentioned, the two nozzle chamber bottoms or plates 4 are each formed with a respective nozzle bore 3.

The body 5 as well as the nozzle chamber bottoms 4 are arranged between stress plates 6 made of steel. At least the body 5 is held under pressure stress by the tensioning screws 7 between the two stress plates 6.

One of the stress plates 6, i.e. the plate 6 shown on the right-hand side in FIG. 1, has an aperture or bore 8 in which the short connecting conduit or nipple 9 is welded at 20.

Figure 3:
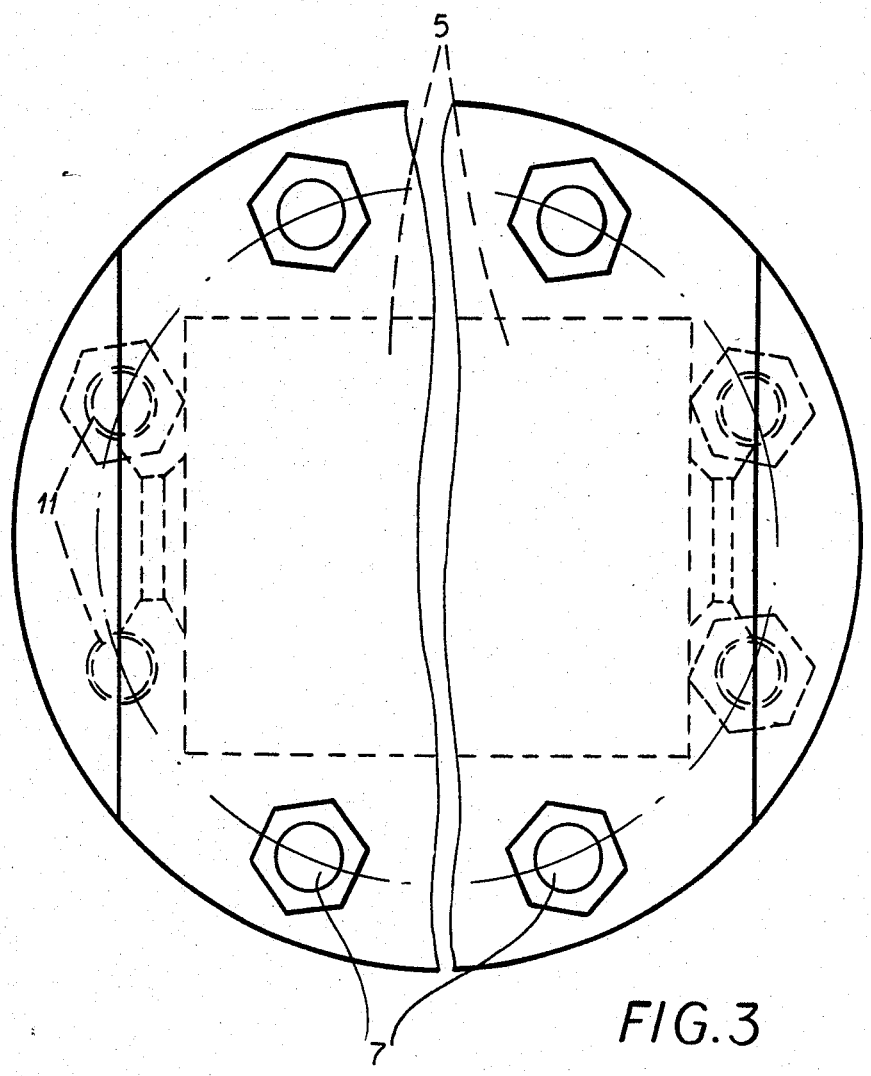
FIG. 3 is an end view of the embodiment of FIG. 1 in the direction of arrow III in FIG. 1.
Figure 4:
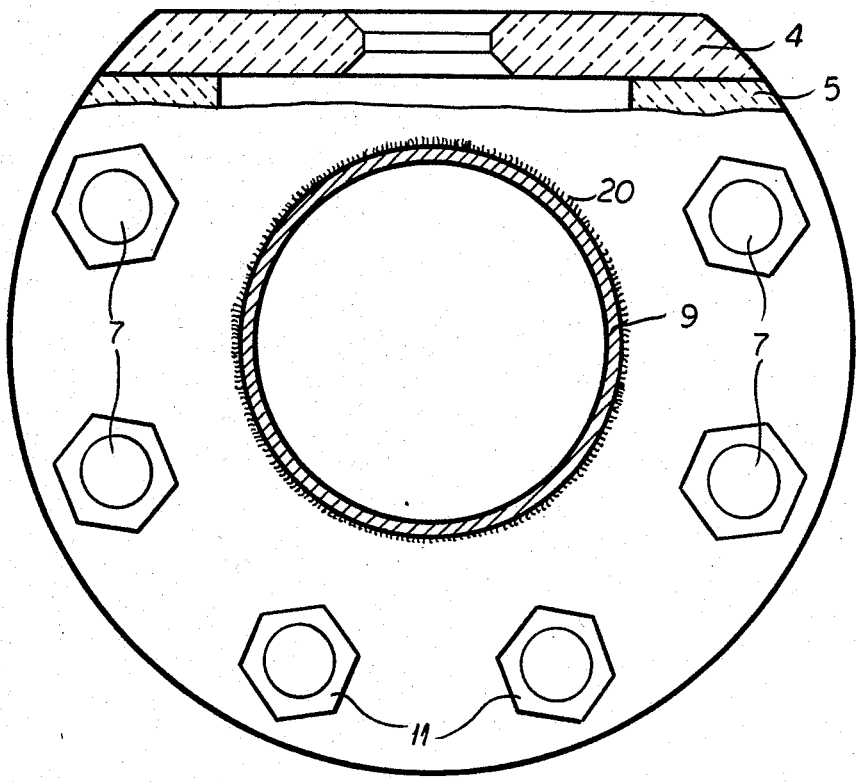
FIG. 4 is a view from the opposite end in section through the nipple and partly broken away of another very similar embodiment.
Figure 5:
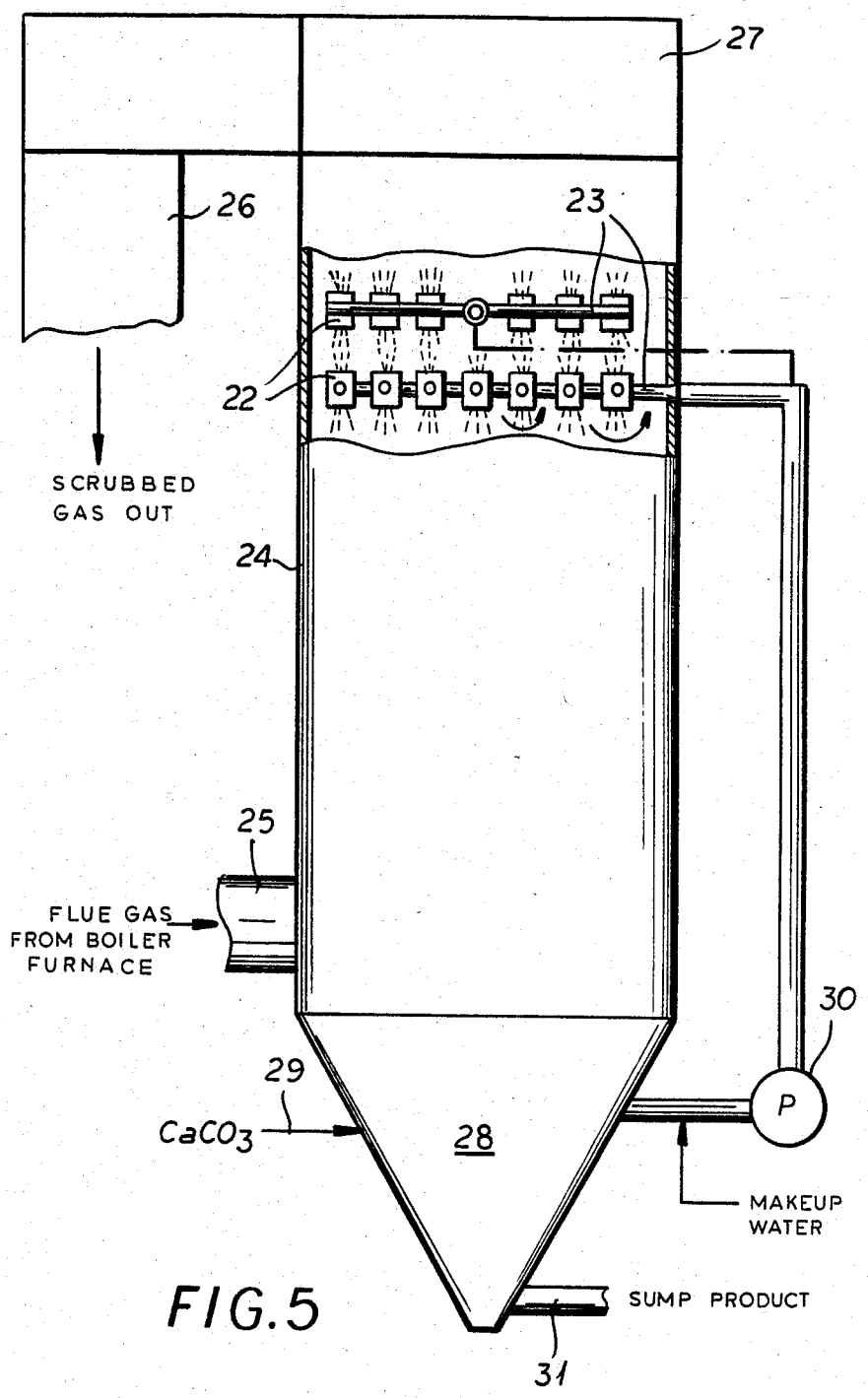
FIG. 5 is an elevation diagrammatically showing a scrubbing tower embodying the swirl nozzles of the invention.

FIG. 3 indicates that the tensioning or stressing screws 7 are distributed about the circumference of the plate 6. The block 5 is provided with a stepped portion or wider formation 10 (see FIGS. 2 and 4), receiving additional screw bolts or bolts 11. Accordingly, stresses to be borne by this stress plate 6, because it carries the connecting nipple 9 and is connected to the feed conduit 2*a* for the scrubber fluid, can be readily absorbed or taken-up thereby. The bolts can be cemented in place at 21.

The body 5 can be divided in a central manner at 12 and the manufacture thereof can be achieved in a simple manner, namely the manufacture or shaping of the nozzle chamber 1 and forming of the inlet 2 for the scrubber fluid into the block 5, preferably by a machining technique involving cutting of the material.

However, it is fully within the scope of the invention to form the body 5 as a unitary component and to mount the nozzle chamber bottoms 4 in a subsequent step.

A multiplicity of such nozzles 22 can be mounted via the scrubber liquid pipes 23 in a scrubber 24 to which the flue gas from the combustion chamber of a power plant boiler is fed at 25. The scrubbed flue gas is discharged from an outlet 26 having traversed a droplet separator 27. The scrubbing liquid is collected in a sump 28 and finely divided limestone or lime milk can be added at 29 to the recirculated sump product when the scrubber is used for desulfurization of the flue gas. The scrubbing liquid is recirculated by the pump 30, makeup water can be added at 31 and the sump product (slurry) discharged at 31. Means can be provided to introduce oxygen into the sump to oxidize any sulfite or bisulfite formed by the scrubbing action to the calcium sulfate. The sump product is readily transformed into or used as gypsum for the building trades. The nozzles of the invention can be used in any of the scrubbers described in the following copending applications:

Ser. No. 580,645 filed 16 Feb. 1984; now U.S. Pat. No. 4,526,764;

Ser. No. 570,038 filed 11 Jan. 1984; now U.S. Pat. No. 4,539,024;

Ser. No. 515,919 filed 20 July 1983 now U.S. Pat. No. 4,513,754.

I claim:

1. A swirl nozzle, especially for a flue gas scrubbing tower for physical and/or chemical cleaning of flue gas from a power plant boiler, said nozzle comprising:

a substantially cylindrical nozzle chamber adapted to receive a scrubber fluid;

at least one tangential scrubber fluid inlet leading into said nozzle chamber for passing scrubber fluid from a source thereof into said nozzle chamber, said nozzle chamber and said tangential scrubber fluid inlet being jointly formed in a body made of ceramic wear material;

at least one nozzle bore for the egress of scrubber fluid from said nozzle chamber formed in a nozzle chamber bottom provided at an end of said body, said nozzle bore extending coaxially with respect to said nozzle chamber, said nozzle chamber bottom being made of ceramic wear material;

a conduit for feeding scrubber fluid to said nozzle chamber, said conduit being connectable at said tangential scrubber fluid inlet, and said conduit being adapted to support said body;

a pair of steel stress plates flanking at least said body, one of said stress plates including an opening communicating with said tangential scrubber fluid inlet; and a plurality of tensioning screws mounted in respective stress plates for maintaining said body under compression prestress.

2. The nozzle defined in claim 1 wherein said body has two nozzle bottoms and each nozzle bottom has a respective nozzle bore.

3. The nozzle defined in claim 1 wherein said nozzle bottoms and said body are made of the same ceramic wear material.

4. The nozzle defined in claim 1 in which said ceramic wear material is silicon carbide.

5. The nozzle defined in claim 4 in which said ceramic wear material is nitrided silicon carbide.

6. The nozzle defined in claim 1 wherein said body is divided in a central plane which extends substantially perpendicularly with respect to the axis of said cylindrical nozzle chamber.

7. The nozzle defined in claim 1 wherein said body is unitary and has a nozzle chamber bottom at each of its ends.

8. The nozzle defined in claim 1 wherein said conduit is welded to said one of said stress plates.

9. The nozzle defined in claim 1 wherein said body includes a widened end formation.

10. A scrubber for the scrubbing of a flue gas which comprises a tower having a gas inlet, and a gas outlet and being traversed by said gas, a plurality of swirl nozzles arranged across a path of said gas between said inlet and said outlet, means for feeding a scrubbing liquid to said nozzles, and a sump for collecting said scrubbing liquid, said swirl nozzles each comprising:

a substantially cylindrical nozzle chamber adapted to receive a scrubber fluid;

at least one tangential scrubber fluid inlet leading into said nozzle chamber for passing scrubber fluid from a source thereof into said nozzle chamber, said nozzle chamber and said tangential scrubber fluid inlet being jointly formed in a body made of ceramic wear material;

at least one nozzle bore for the egress of scrubber fluid from said nozzle chamber formed in a nozzle chamber bottom provided at an end of said body, said nozzle bore extending coaxially with respect to said nozzle chamber, said nozzle chamber bottom being made of ceramic wear material;

a conduit for feeding scrubber fluid to said nozzle chamber, said conduit being connectable at said tangential scrubber fluid inlet, and said conduit being adapted to support said body;

a pair of steel stress plates flanking at least said body, one of said stress plates including an opening communicating with said tangential scrubber fluid inlet; and a plurality of tensioning screws mounted in respective stress plates for maintaining said body under compression prestress.

11. The scrubber defined in claim 10 wherein said body has two nozzle bottoms and each nozzle bottom has a respective nozzle bore.

12. The scrubber defined in claim 10 wherein said nozzle bottoms and said body are made of the same ceramic wear material.

13. The scrubber defined in claim 10 in which said ceramic wear material is silicon carbide.

14. The scrubber defined in claim 13 in which said ceramic wear material is nitrided silicon carbide.

15. The scrubber defined in claim 10 wherein said body is divided in a central plane which extends substantially perpendicularly with respect to the axis of said cylindrical nozzle chamber.

16. The scrubber defined in claim 10 wherein said body is unitary and has a nozzle chamber bottom at each of its ends.

17. The scrubber defined in claim 10 wherein said conduit is welded to said one of said stress plates.

* * * * *